US011918051B2

(12) United States Patent
Huang et al.

(10) Patent No.: US 11,918,051 B2
(45) Date of Patent: Mar. 5, 2024

(54) ELECTRONIC CIGARETTE AND POWER CONTROL METHOD THEREOF

(71) Applicant: SHENZHEN FIRST UNION TECHNOLOGY CO., LTD., Shenzhen (CN)

(72) Inventors: Linjian Huang, Shenzhen (CN); Yonghai Li, Shenzhen (CN); Zhongli Xu, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 611 days.

(21) Appl. No.: 17/265,933

(22) PCT Filed: Aug. 12, 2019

(86) PCT No.: PCT/CN2019/100248
§ 371 (c)(1),
(2) Date: Feb. 4, 2021

(87) PCT Pub. No.: WO2020/038249
PCT Pub. Date: Feb. 27, 2020

(65) Prior Publication Data

US 2021/0298365 A1 Sep. 30, 2021

(30) Foreign Application Priority Data

Aug. 18, 2018 (CN) ..... 201810943775.0

(51) Int. Cl.
*H05B 6/10* (2006.01)
*A24F 40/53* (2020.01)
(Continued)

(52) U.S. Cl.
CPC ..... *A24F 40/57* (2020.01); *A24F 40/53* (2020.01); *A24F 40/60* (2020.01)

(58) Field of Classification Search
CPC ..... A24F 40/50; A24F 40/53; A24F 40/57; A24F 40/60; G05F 1/66; H05B 6/10
(Continued)

(56) References Cited

U.S. PATENT DOCUMENTS 5,902,501 A * 5/1999 Nunnally ..... A24F 40/40 219/269
6,803,550 B2 * 10/2004 Sharpe ..... H05B 6/105 219/635
10,088,463 B2 * 10/2018 Blackley ..... G01N 33/0027

FOREIGN PATENT DOCUMENTS

CN 105302223 A 2/2016
CN 106579563 A 4/2017
(Continued)

*Primary Examiner* — Quang T Van
(74) *Attorney, Agent, or Firm* — PROI Intellectual Property US; Klaus Michael Schmid

(57) ABSTRACT

The present disclosure relates to electronic cigarettes, and in particular to an electronic cigarette and a power control method thereof. The power control method is used for controlling an output power of a power device to a heating element, and the method includes: determining a target power; setting an intermediate power according to the target power, the intermediate power being less than the target power; controlling the power device to output a power to the heating element, and enabling the output power of the power device to directly reach the intermediate power at a first stage; adjusting the output power of the power device to gradually reach the target power at a second stage, a duration of the first stage being less than a duration of the second stage; and controlling the power device to constantly output the target power to the heating element at a third stage.

15 Claims, 7 Drawing Sheets

(51) Int. Cl.
*A24F 40/57* (2020.01)
*A24F 40/60* (2020.01)

(58) Field of Classification Search
USPC ..... 219/661, 628, 629, 630, 631, 634, 635, 219/688, 759, 650, 663, 664, 665, 666, 219/672; 131/270, 273, 329; 128/202.21, 200.14; 392/394, 395, 390; 206/242, 249, 251, 252, 261, 263, 265
See application file for complete search history.

(56) References Cited

FOREIGN PATENT DOCUMENTS

| | | | |
|---|---|---|---|
| CN | 106973449 | A | 7/2017 |
| CN | 107296301 | A | 10/2017 |
| CN | 108158045 | A | 6/2018 |
| CN | 108835718 | A | 11/2018 |
| WO | 2017096512 | A1 | 6/2017 |

* cited by examiner

ELECTRONIC CIGARETTE AND POWER CONTROL METHOD THEREOF

This application claims priority to Chinese Patent Application entitled "Electronic cigarette and power control method of thereof" with application number of 201810943775.0, submitted to China National Intellectual Property Administration on Aug. 18, 2018, the entire contents of which are incorporated herein by reference.

TECHNICAL FIELD

The embodiment of the present disclosure relates to the technical field of electronic cigarettes, and in particular to an electronic cigarette and a power control method thereof.

BACKGROUND

Electronic cigarette is a product which can heat atomization substrates such as nicotine to generate an aerosol for a user to inhale. The electronic cigarette generally includes a power device, a heating element and a controller. The power device is controlled through the controller to output a power to the heating element, so that the heating element heats and atomizes the atomization substrate to generate an aerosol according to the power, thereby implementing the ignition of the electronic cigarette.

At present, the electronic cigarette controls the power device to output a power to the heating element according to a user set power, moreover, in order to prevent a power overshoot, the output power of the power device is attenuated and proportionally adjusted at the whole stage, so that the output power of the power device rises slowly to gradually reach the user set power and is constantly output at the user set power (as shown in FIG. 1*a*).

However, the inventor finds in the process of implementing the present disclosure that: the whole stage of attenuation and proportional adjustment of the output power of the power device will result in a long power rise time, thereby leading to a long aerosolization time of the electronic cigarette and affecting the user experience.

SUMMARY

The embodiment of the present disclosure aims to provide an electronic cigarette and a power control method thereof, which can shorten the power rise time and improve the ignition speed of the electronic cigarette.

In order to solve the above technical problem, the embodiment of the present disclosure employs a technical scheme as follows. A power control method of an electronic cigarette is provided, which is used for controlling an output power of a power device to a heating element, wherein the power control method of the electronic cigarette includes the following steps:

determining a target power;

setting an intermediate power according to the target power, the intermediate power being less than the target power;

controlling the power device to output a power to the heating element, and enabling the output power of the power device to directly reach the intermediate power at a first stage;

adjusting the output power of the power device to gradually reach the target power at a second stage, a duration of the first stage being less than a duration of the second stage; and controlling the power device to constantly output the target power to the heating element at a third stage.

Optionally, the duration of the first stage is less than 50 microseconds.

Optionally, before determining the target power, the method further includes: receiving a start instruction, the start instruction including a user set power.

Optionally, the method further includes:

measuring a current voltage of the power device and a resistance value of the heating element; and calculating a maximum allowed power of the electronic cigarette according to the current voltage of the power device and the resistance value of the heating element.

Optionally, the step of determining a target power specifically includes:

comparing the maximum allowed power with the user set power;

if the maximum allowed power is less than the user set power, determining the maximum allowed power as the target power;

otherwise, determining the user set power as the target power.

Optionally, when the target power is the maximum allowed power, the step of setting an intermediate power according to the target power specifically includes:

judging whether the maximum allowed power is less than a first threshold, if the maximum allowed power is less than the first threshold, setting the intermediate power to be 80%-90% of the maximum allowed power;

otherwise, judging whether the maximum allowed power is less than a second threshold, if the maximum allowed power is less than the second threshold, setting the intermediate power to be 70%-80% of the maximum allowed power;

otherwise, setting a preset optimum power as the intermediate power.

Optionally, when the target power is the user set power, the step of setting an intermediate power according to the target power specifically includes:

judging whether the user set power is less than a first threshold, if the user set power is less than the first threshold, setting the intermediate power to be 80%-90% of the user set power;

otherwise, judging whether the user set power is less than a second threshold, if the user set power is less than the second threshold, setting the intermediate power to be 70%-80% of the user set power;

otherwise, setting a preset optimum power as the intermediate power.

Optionally, the step of adjusting the output power of the power device to gradually reach the target power at a second stage specifically includes:

performing an incremental PID control according to the intermediate power and the target power.

In order to solve the above technical problem, the embodiment of the present disclosure employs another technical scheme as follows. A power control device of an electronic cigarette is provided, which is used for controlling an output power of a power device to a heating element, wherein the power control device of the electronic cigarette includes:

a determination module, which is used for determining a target power;

a setting module, which is used for setting an intermediate power according to the target power, the intermediate power being less than the target power;

a first control module, which is used for controlling the power device to output a power to the heating element, and enabling the output power of the power device to directly reach the intermediate power at a first stage;

an adjustment module, which is used for adjusting the output power of the power device to gradually reach the target power at a second stage, a duration of the first stage being less than a duration of the second stage; and a second control module, which is used for controlling the power device to constantly output the target power to the heating element at a third stage.

Optionally, the device further includes:

a receiving module, which is used for receiving a start instruction before determining the target power, the start instruction including a user set power.

Optionally, the device further includes:

a measurement module, which is used for measuring a current voltage of the power device and a resistance value of the heating element; and a calculation module, which is used for calculating a maximum allowed power of the electronic cigarette according to the current voltage of the power device and the resistance value of the heating element.

Optionally, the determination module further includes:

a comparison module, which is used for comparing the maximum allowed power with the user set power;

if the maximum allowed power is less than the user set power, determining the maximum allowed power as the target power;

otherwise, determining the user set power as the target power.

Optionally, when the target power is the maximum allowed power, the setting module further includes:

a judgement module, which is used for judging whether the maximum allowed power is less than a first threshold, and if the maximum allowed power is less than the first threshold, setting the intermediate power to be 80%-90% of the maximum allowed power;

otherwise, judging whether the maximum allowed power is less than a second threshold, if the maximum allowed power is less than the second threshold, setting the intermediate power to be 70%-80% of the maximum allowed power;

otherwise, setting a preset optimum power as the intermediate power.

Optionally, when the target power is the user set power, the judgement module is further used for:

judging whether the user set power is less than a first threshold, if the user set power is less than the first threshold, setting the intermediate power to be 80%-90% of the user set power;

otherwise, judging whether the user set power is less than a second threshold, if the user set power is less than the second threshold, setting the intermediate power to be 70%-80% of the user set power;

otherwise, setting a preset optimum power as the intermediate power.

In order to solve the above technical problem, the embodiment of the present disclosure employs another technical scheme as follows. An electronic cigarette is provided, which includes:

at least one processor; and a memory in communication connection with the at least one processor; wherein the memory stores an instruction that can be executed by the at least one processor, and the instruction is executed by the at least one processor so that the at least one processor can execute the method described above.

In order to solve the above technical problem, the embodiment of the present disclosure employs another technical scheme as follows. A non-volatile computer readable storage medium is provided, wherein the non-volatile computer readable storage medium stores a computer executable instruction, which is used for enabling the electronic cigarette to execute the above method.

The embodiment of the present disclosure has the following beneficial effects: the embodiment of the present disclosure provides an electronic cigarette and a power control method thereof that differ from existing technologies. The power control method of the electronic cigarette controls, through setting an intermediate power less than a target power according to the target power, the output power of the power device to directly reach the intermediate power at a first stage, then adjusts the output power of the power device to gradually reach the target power from the intermediate power at a second stage, and finally constantly outputs the target power at a third stage (as shown in FIG. 1*b*), thereby shortening the process of power attenuation and proportional adjustment at the first stage, so that the power rise time is shortened; therefore, the aerosolization time of the electronic cigarette is shortened, the ignition speed of the electronic cigarette is improved, and the user experience is better.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form restrictions unless otherwise stated.

DETAILED DESCRIPTION

To make the purpose, the technical scheme and the advantages of the disclosure more apparent, a clear and complete description is provided to the technical scheme in the embodiment of the present disclosure in conjunction with the drawings in the embodiment of the present disclosure. Obviously, the embodiments described hereinafter are simply part embodiments of the present disclosure, but all the embodiments. All other embodiments obtained by the ordinary skill in the art based on the embodiments in the present disclosure without creative work are intended to be included in the scope of protection of the present disclosure.

It is to be noted that when an element is described as "fixed on" another element, it may be directly on the another element, or there might be one or more intermediate elements between them. When one element is described as "connected to" another element, it may be directly connected to the another element, or there might be one or more intermediate elements between them. Terms "vertical", "horizontal", "left", "right" and similar expressions used in this description are merely for illustration.

In addition, technical features involved in each embodiment of the present disclosure described below can be combined mutually if no conflict is incurred.

Embodiment 1

Figure 2:
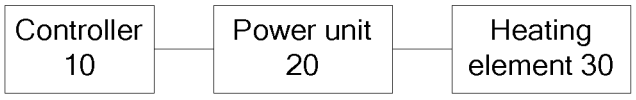
FIG. 2 is a structure diagram of an electronic cigarette provided in an embodiment of the present disclosure.

Referring to FIG. 2, the embodiment of the present disclosure provides a structure diagram of an electronic cigarette. The electronic cigarette includes: a controller 10, a power device 20 and a heating element 30. The controller 10 is connected to the power device 20, and the power device 20 is connected to the heating element 30. The controller 10 is used for controlling the power device 20, the power device 20 is used for outputting a power to supply power for the heating element 30, the heating element 30 is used for heating an atomization substrate to generate an aerosol. In the embodiment of the present disclosure, the power device 20 can be controlled through the controller 10 to output a power to the heating element 30, so that the heating element 30 heats the atomization substrate to generate an aerosol according to the power output by the power device 20, thereby achieving the ignition of the electronic cigarette.

Herein, the above power device 20 may be a battery cell arranged inside the electronic cigarette, which can be electrically connected to the controller 10 and the heating element 30 directly; of course, in one alternative embodiments, the power device 20 may also be an external power device connected to the electronic cigarette through a power interface.

The above heating element 30 may be an element that can be heated when powered by the power device 20, such as a heating coil, a heating sheet, a heating plate and the like. The heating element 30, when heated to certain degree, can atomize the atomization substrate to generate aerosol particles.

The above atomization substrate may be a cigarette, also may be a tobacco liquid for electronic cigarettes. The main components of the tobacco liquid are edible grade or medical grade glycerinum, 1, 2-propylene glycol, polyethylene glycol and tobacco dedicated flavors. The tobacco liquid contains an ingredient of nicotine, such that the taste of the electronic cigarette is closer to conventional cigarettes.

The above ignition refers to the aerosolization of the electronic cigarette; the fast ignition speed of the electronic cigarette refers to the fast aerosolization speed of the electronic cigarette. In electronic cigarettes, the ignition speed is related to a power rise speed of an output power from the power device 20 to the heating element 30; the faster the output power from the power device 20 to the heating element 30 rises, the faster the heating element 30 is heated, thus the quicker the electronic cigarette is aerosolized.

Figure 1A:
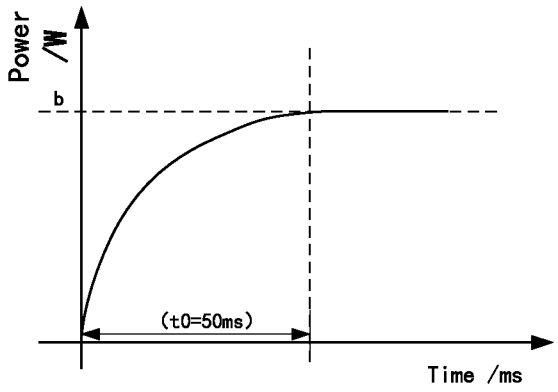
FIG. 1*a* is a diagram of a relationship between a power and a time in an existing power control method of an electronic cigarette.
Figure 1B:
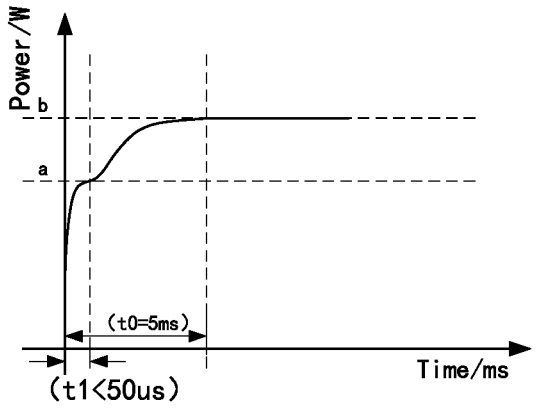
FIG. 1B is a diagram of a relationship between a power and a time in a power control method of an electronic cigarette provided in an embodiment of the present disclosure.

In existing technologies, during the process in which the power device outputs a power to the heating element, in order to prevent a power overshoot, the power is attenuated and proportionally adjusted (as shown in FIG. 1*a*) at the whole power rise phase for the output power of the power device, thus the power rise time is long, resulting in a slow ignition speed. Based on this, in order to shorten the power rise time and improve the ignition speed of the electronic cigarette, the embodiment of the present disclosure provides a power control method of an electronic cigarette, which controls, through setting an intermediate power less than a target power according to the target power, the output power of the power device to directly reach the intermediate power at a first stage, then adjusts the output power of the power device to gradually reach the target power from the intermediate power at a second stage, and finally constantly outputs the target power at a third stage (as shown in FIG. 1*b*), thereby shortening the process of power attenuation and proportional adjustment at the first stage, so that the power rise time is shortened and the ignition speed of the electronic cigarette is improved.

That is to say, in the embodiment of the present disclosure, the controller 10 is mainly used for executing the power control method of the electronic cigarette provided in the embodiment of the present disclosure, and it controls the power device 20 to output a power to the heating element 30 according to the power control method of the electronic cigarette, so as to shorten the power rise time and improve the ignition speed of the electronic cigarette, thereby achieving a fast ignition speed of the electronic cigarette.

Specifically, after the connection between the controller 10, the power device and the heating element 30 is completed, the controller 10 measures a current voltage U1 of the power device 20 and a resistance value R1 of the heating element and calculates a maximum allowed power P1 ( $$\left(P_1 = \frac{U_1^2}{R_1}\right)$$

) of the electronic cigarette according to the current voltage U1 of the power device 20 and the resistance value R1 of the heating element 30. The maximum allowed power is a maximum power that the power device 20 can output to the heating element 30.

Then, the controller 10 judges whether a start instruction is received; if so, the controller determines a target power according to the start instruction.

Herein, the start instruction is an instruction generated when a user presses on an ignition button of the electronic cigarette, including a user set power, that is to say, when a user presses on an ignition button of the electronic cigarette, the controller 10 receives a start instruction.

The target power is a power that the output power of the power device 20 will finally reach and will be constantly output in the power rise process, the target power may be the user set power, also may be the maximum allowed power of the electronic cigarette. The maximum allowed power of the electronic cigarette is a maximum power that the power device 20 can output to the heating element 30; if the user set power is greater than the maximum allowed power of the electronic cigarette, then the output power of the power device 20 cannot reach the user set power; therefore, after receiving the start instruction, the controller 10 needs to compare the maximum allowed power of the electronic cigarette with the user set power contained in the start instruction, to determine whether the target power is the user set power or the maximum allowed power.

Specifically, the controller 10 compares the maximum allowed power with user set power; if the maximum allowed power is less than the user set power, the controller determines the maximum allowed power as the target power; otherwise, the controller 10 determines the user set power as the target power.

When the target power is the maximum allowed power, the controller 10 sets the intermediate power according to the maximum allowed power, including the following steps:

- the controller 10 judges whether the maximum allowed power is less than a first threshold, if the maximum allowed power is less than the first threshold, the controller sets the intermediate power to be 80%-90% of the maximum allowed power;
- otherwise, the controller 10 judges whether the maximum allowed power is less than a second threshold, if the maximum allowed power is less than the second threshold, the controller 10 sets the intermediate power to be 70%-80% of the maximum allowed power;
- otherwise, the controller 10 sets a preset optimum power as the intermediate power.

When the target power is the user set power, the controller 10 sets the intermediate power according to the user set power, including the following steps:

- the controller 10 judges whether the user set power is less than a first threshold, if the user set power is less than the first threshold, the controller 10 sets the intermediate power to be 80%-90% of the user set power;
- otherwise, the controller 10 judges whether the user set power is less than a second threshold, if the user set power is less than the second threshold, the controller sets the intermediate power to be 70%-80% of the user set power;
- otherwise, the controller 10 sets a preset optimum power as the intermediate power.

Herein, the first threshold and the second threshold are maximum powers set according to a power overshoot scope, for example, when setting a threshold, if powers less than the threshold are required to have an overshot scope less than 0.3W, then a maximum power with an overshot scope less than 0.3W is set as the threshold. Herein, the power overshoot scope corresponding to each power is an empirical value obtained through multiple times of overshoot experiments.

Herein, the first threshold is set according to a power overshoot scope less than 0.5W, and a maximum power with a power overshoot scope less than 0.5W is therefore, the first threshold is set to be 30W.

The second threshold is set according to a power overshoot scope less than 1W, and a maximum power with a power overshoot scope less than 1W is 75W; therefore, the second threshold is set to be 75W.

The preset optimum power is a power obtained through multiple times of aerosolization experiments of the electronic cigarette, at which an outburst of aerosol can be produced; the preset optimum power is a constant value, for example, in an aerosolization experiment of the electronic cigarette, when the electronic cigarette has a power of 50W, the electronic cigarette can quickly produce an outburst of aerosol, then 50W is set as the preset optimum power.

Of course, in some alternative embodiments, the preset optimum power can be determined according to a preset power table, which is formulated by empirical values obtained from multiple times of aerosolization experiments of the electronic cigarette, including parameters such as a resistance value of the heating element, a power, and an outburst time of aerosol; for a corresponding heating element resistance value, the power at which the outburst time of aerosol is shortest is determined as the preset optimum power.

Preferably, in the embodiment of the present disclosure, the preset optimum power is 60W.

After setting the intermediate power according to the determined target power, the controller 10 controls the power device 20 to output a power to the heating element 20, so that the output power of the power device 20 directly reaches the intermediate power at a first stage, then the controller 10 adjusts the output power of the power device 20 to gradually reach the target power at a second stage, and finally controls the power device 20 to constantly output the target power to the heating element 30 at a third stage.

At the first stage, the output power of the power device 20 directly reaches the intermediate power without power attenuation and proportional adjustment. The duration of the first stage is less than 50 us.

Since the intermediate power is less than the target power and the intermediate power is 80%-90% of the target power or 70%-80% of the target power, in the condition that power attenuation and proportional adjustment are not performed at the first stage, the output power of the power device 20 will not reach the target power even if a power overshoot occurs; therefore, the output power from the power device 20 to the heating element 30 can be controlled to directly reach the intermediate power without exceeding the target power at the first stage, which greatly shortens the power rise time.

At the second stage, the output power of the power device 20 is adjusted to gradually reach the target power; since the output power of the power device 20 is adjusted at the second stage, the duration of the first stage is less than the duration of the second stage.

The step that the output power of the power device 20 is adjusted to gradually reach the target power at the second stage includes:

- performing an incremental PID control according to the intermediate power and the target power.

Specifically, the controller 10 calculates a power output proportion according to a difference value between the intermediate power and the target power, and then the controller 10 controls, according to the power output proportion, the power of the electronic cigarette to gradually reach the target power from the intermediate power.

The embodiment of the present disclosure provides an electronic cigarette, which executes the power control method through a controller 10 of the electronic cigarette, so that the power rise time is shortened; therefore, the aerosolization time of the electronic cigarette is shortened, the ignition speed of the electronic cigarette is improved, and the user experience is better.

Embodiment 2

Figure 3:
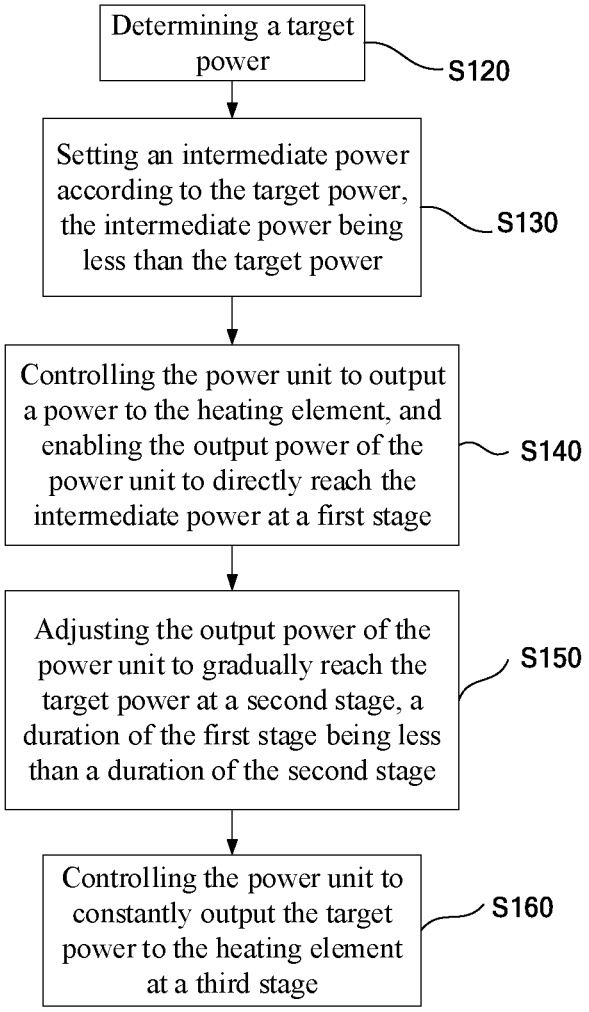
FIG. 3 is a flowchart of a power control method of an electronic cigarette provided in an embodiment of the present disclosure.

Referring to FIG. 3, the embodiment of the present disclosure provides a flowchart of a power control method of an electronic cigarette, which is applied to the electronic cigarette; the electronic cigarette is the electronic cigarette mentioned in the above embodiment. The method provided by the embodiment of the present disclosure is executed by the above controller 10, and is used for controlling an output power of a power device to a heating element, wherein the power control method of the electronic cigarette includes the following steps:

S120: determining a target power.

The target power is a power that the output power of the power device will finally reach and will be constantly output in the power rise process.

Figure 4:
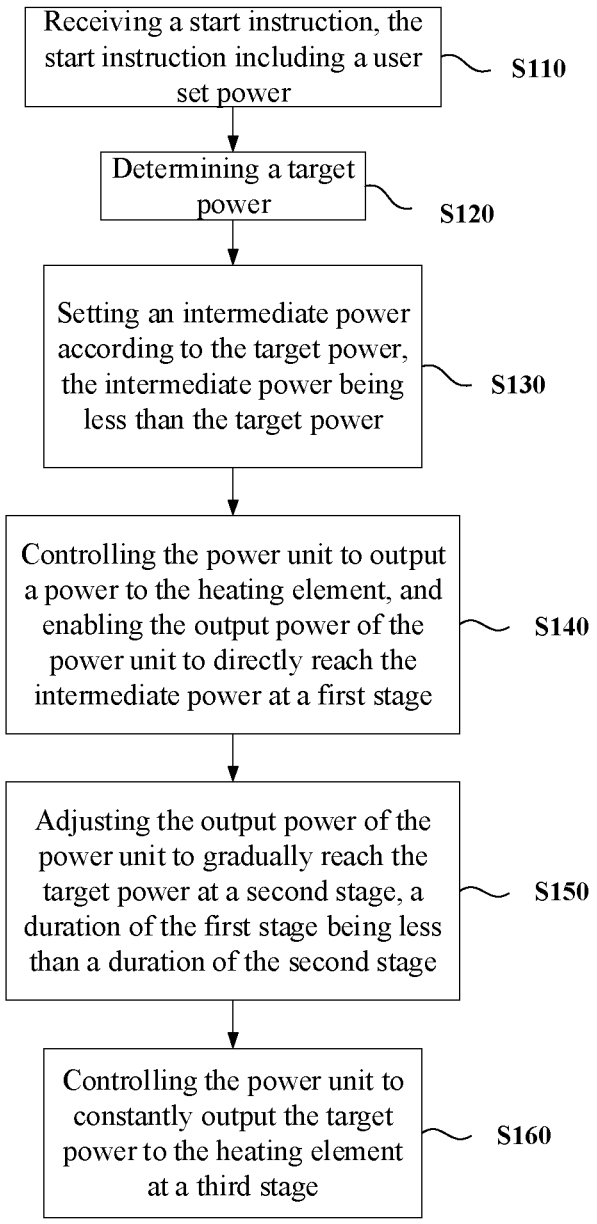
FIG. 4 is a flowchart of a power control method of an electronic cigarette provided in another embodiment of the present disclosure.

Before the step of determining a target power, referring to FIG. 4, the power control method of the electronic cigarette further includes:

S110: receiving a start instruction, the start instruction including a user set power.

The start instruction mentioned above is an instruction generated when a user presses on an ignition button of the electronic cigarette.

The user set power mentioned above is a power value set by a user on a panel of the electronic cigarette through a setting button of the electronic cigarette; the user set power can be adjusted according to the smoking taste of electronic cigarette in the usage process of the electronic cigarette, including increasing or decreasing.

When a user presses on an ignition button of the electronic cigarette, a start instruction is generated; then, the power value set by the user on the panel of the electronic cigarette through the setting button of the electronic cigarette, along with the start instruction, will be received by the controller.

At this time, the step of determining a target power specifically includes: determining a user set power as the target power.

Figure 5:
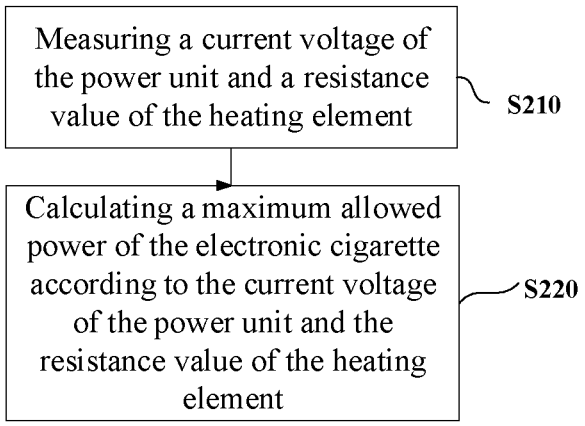
FIG. 5 is a partial flowchart of a power control method of an electronic cigarette provided in another embodiment of the present disclosure.

Of course, in some alternative embodiments, referring to FIG. 5, the power control method of the electronic cigarette further includes:

S210: measuring a current voltage of the power device and a resistance value of the heating element.

The current voltage of the power device mentioned above is a maximum voltage that the remaining capacity of the power device can supply.

The resistance value of the heating element mentioned above is a rated resistance of the heating element; and different heating elements have different resistances.

Specifically, after the connection between the controller, the power device and the heating element is completed, the controller can measure the current voltage of the power device and the resistance value of the heating element.

S220: calculating a maximum allowed power of the electronic cigarette according to the current voltage of the power device and the resistance value of the heating element.

The maximum allowed power mentioned above is a maximum power that the power device can output to the heating element and is calculated through the current voltage of the power device and the resistance value of the heating element according to a formula $$P = \frac{U^2}{R}.$$

At this time, the target power may be the user set power contained in the start instruction received by the controller, also may the maximum allow power of the electronic cigarette calculated by the controller according to the current voltage of the power device and the resistance value of the heating element.

Figure 6:
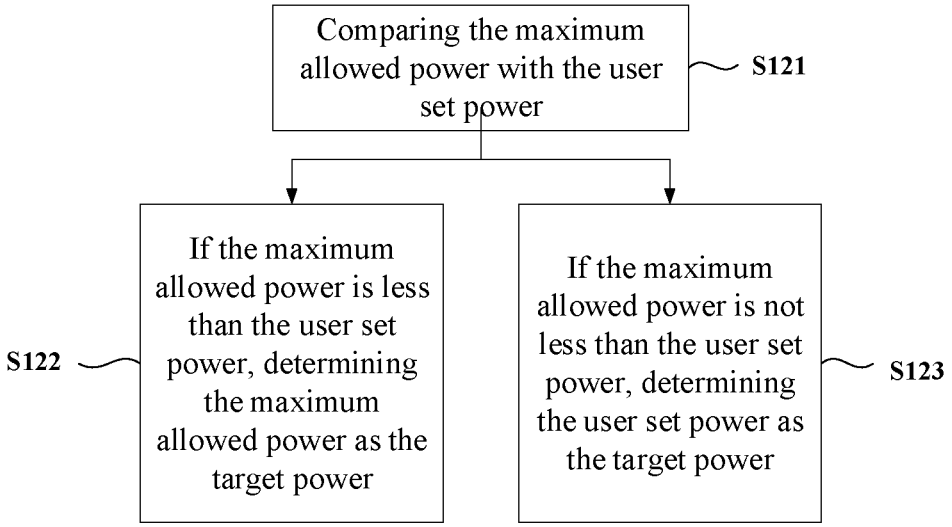
FIG. 6 is a specific flowchart of S120.

Based on this, referring to FIG. 6, the step of determining a target power specifically includes:

S121: comparing the maximum allowed power with the user set power;

S122: if the maximum allowed power is less than the user set power, determining the maximum allowed power as the target power;

S123: if the maximum allowed power is not less than the user set power, determining the user set power as the target power.

Since the maximum allowed power of the electronic cigarette is a maximum power that the power device can output to the heating element, if the user set power is greater than the maximum allowed power of the electronic cigarette, it is possible to result in that the power output by the power device cannot reach the user set power; therefore, it is needed to compare the maximum allowed power of the electronic cigarette with the user set power to determine whether the target power is the user set power or the maximum allowed power.

S130: setting an intermediate power according to the target power, the intermediate power being less than the target power.

The intermediate power mentioned above is a power less than the target power calculated according to the target power, which enables the output power of the power device not to reach the target power even if a power overshoot occurs when the intermediate power is reached.

When the target power is the maximum allowed power, the intermediate power is set according to the maximum allowed power.

Figure 7A:
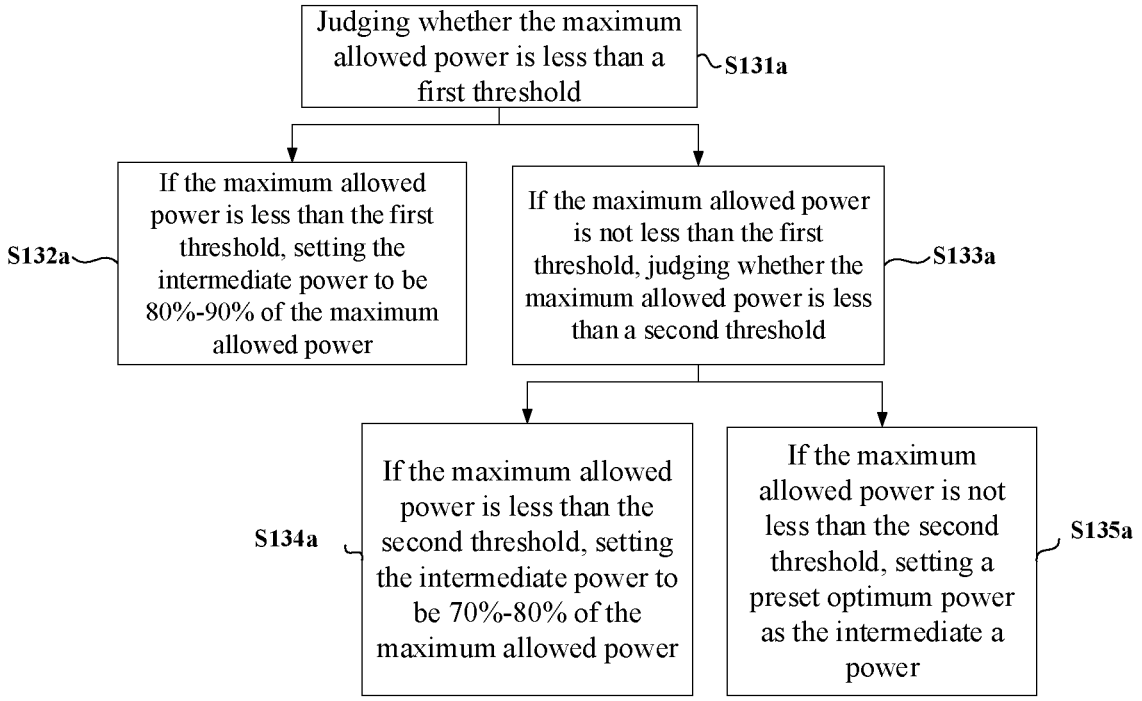
FIG. 7*a* is specific flowchart of S130 when a target power is a maximum allowed power.

Referring to FIG. 7*a*, S130 specifically includes:

S131*a*: judging whether the maximum allowed power is less than a first threshold.

The threshold is a maximum power set according to the power overshoot scope. For example, when setting a threshold, if powers less than the threshold are required to have an overshot scope less than 0.3W, then a maximum power with an overshot scope less than 0.3W is set as the threshold. Herein, the power overshoot scope corresponding to each power is an empirical value obtained through multiple times of overshoot experiments. In the embodiment of the present disclosure, the threshold incudes a first threshold and a second threshold.

Herein, the first threshold is set according to a power overshoot scope less than 0.5W, and a maximum power with a power overshoot scope less than 0.5W is therefore, the first threshold is set to be 30W.

Of course, in some alternative embodiments, the first threshold can also be set according to other power overshoot scopes.

The step of judging whether the maximum allowed power is less than a first threshold specifically includes: judging whether the maximum allowed power is less than 30W, so as to determine the method of setting an intermediate power.

S132*a*: if the maximum allowed power is less than the first threshold, setting the intermediate power to be 80%-90% of the maximum allowed power.

When the maximum allowed power is less than 30W and the power overshoot scope is less than 0.5W, the intermediate power is set to be 80%-90% of the maximum allowed power, preferably, the intermediate power is set to be 90% of the maximum allowed power.

S133*a*: if the maximum allowed power is not less than the first threshold, judging whether the maximum allowed power is less than a second threshold.

The second threshold mentioned above is set according to a power overshoot scope less than 1W, and a maximum power with a power overshoot scope less than 1W is 75W; therefore, the second threshold is set to be 75W.

Of course, in some alternative embodiments, the second threshold can also be set according to other power overshoot scopes. However, a maximum value of the power overshoot scope of the second threshold is greater than a maximum value of the power overshoot scope of the first threshold, for example, 1W is greater than 0.5W.

When the maximum allowed power is not less than 30W and the power overshoot scope is not less than 0.5W, it is needed to judge whether the maximum allowed power is less than 75W.

S134*a*: if the maximum allowed power is less than the second threshold, setting the intermediate power to be 70%-80% of the maximum allowed power.

When the maximum allowed power is greater than or equal to 30W but less than 75W, and the power overshoot scope is greater than or equal to 0.5W but less than 1W, the intermediate power is set to be 70%-80% of the maximum allowed power, preferably, the intermediate power is set to be 80% of the maximum allowed power, S135*a*: if the maximum allowed power is not less than the second threshold, setting a preset optimum power as the intermediate power.

The preset optimum power mentioned above is a power obtained through multiple times of aerosolization experiments of the electronic cigarette, at which an outburst of aerosol can be produced; the preset optimum power is a constant value, for example, in an aerosolization experiment of the electronic cigarette, when the electronic cigarette has a power of 50W, the electronic cigarette can quickly produce an outburst of aerosol, then 50W is set as the preset optimum power.

Of course, in some alternative embodiments, the preset optimum power can be determined according to a preset power table, which is formulated by empirical values obtained from multiple times of aerosolization experiments of the electronic cigarette, including parameters such as a resistance value of the heating element, a power, and an outburst time of aerosol; for a corresponding heating element resistance value, the power at which the outburst time of aerosol is shortest is determined as the preset optimum power.

Preferably, in the embodiment of the present disclosure, the preset optimum power is 60W.

When the maximum allowed power is not less than 75W and the power overshoot scope is not less than 1W, it is needed to set the intermediate power to be so that an outburst of aerosol can be produced when the output power of the power device reaches the intermediate power.

When the target power is the user set power, the intermediate power is set according to the user set power.

Figure 7B:
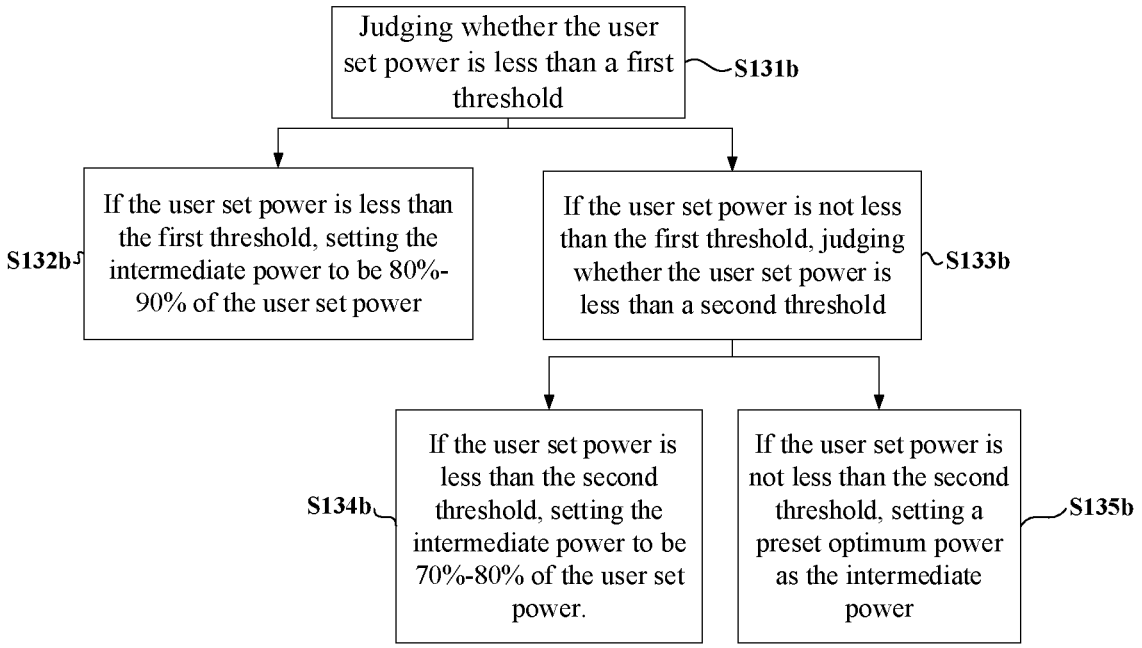
FIG. 7*b* is specific flowchart of S130 when a target power is a user set power.

Referring to FIG. 7*b*, S130 specifically includes:

S131*b*: judging whether the user set power is less than a first threshold.

The threshold is a maximum power set according to the power overshoot scope, for example, when setting a threshold, if powers less than the threshold are required to have an overshot scope less than 0.3W, then a maximum power with an overshot scope less than 0.3W is set as the threshold. Herein, the power overshoot scope corresponding to each power is an empirical value obtained through multiple times of overshoot experiments. In the embodiment of the present disclosure, the threshold incudes a first threshold and a second threshold.

Herein, the first threshold is set according to a power overshoot scope less than 0.5W, and a maximum power with a power overshoot scope less than 0.5W is therefore, the first threshold is set to be 30W.

Of course, in some alternative embodiments, the first threshold can also be set according to other power overshoot scopes.

The step of judging whether the user set power is less than a first threshold specifically includes: judging whether the user set power is less than 30W, so as to determine the method of setting an intermediate power.

S132*b*: if the user set power is less than the first threshold, setting the intermediate power to be 80%-90% of the user set power.

When the user set power is less than 30W and the power overshoot scope is less than 0.5W, the intermediate power is set to be 80%-90% of the user set power, preferably, the intermediate power is set to be 90% of the user set power.

S133*b*: if the user set power is not less than the first threshold, judging whether the user set power is less than a second threshold.

The second threshold mentioned above is set according to a power overshoot scope less than 1W, and a maximum power with a power overshoot scope less than 1W is 75W; therefore, the second threshold is set to be 75W.

Of course, in some alternative embodiments, the second threshold can also be set according to other power overshoot scopes. However, a maximum value of the power overshoot scope of the second threshold is greater than a maximum value of the power overshoot scope of the first threshold, for example, 1W is greater than 0.5W.

When the user set power is not less than 30W and the power overshoot scope is not less than 0.5W, it is needed to judge whether the user set power is less than 75W.

S134*b*: if the user set power is less than the second threshold, setting the intermediate power to be 70%-80% of the user set power.

When the user set power is greater than or equal to 30W but less than 75W, and the power overshoot scope is greater than or equal to 0.5W but less than 1W, the intermediate power is set to be 70%-80% of the user set power, preferably, the intermediate power is set to be 80% of the user set power, S135*b*: if the user set power is not less than the second threshold, setting a preset optimum power as the intermediate power.

The preset optimum power mentioned above is a power obtained through multiple times of aerosolization experiments of the electronic cigarette, at which an outburst of aerosol can be produced; the preset optimum power is a constant value, for example, in an aerosolization experiment of the electronic cigarette, when the electronic cigarette has a power of 50W, the electronic cigarette can quickly produce an outburst of aerosol, then 50W is set as the preset optimum power.

Of course, in some alternative embodiments, the preset optimum power can be determined according to a preset power table, which is formulated by empirical values obtained from multiple times of aerosolization experiments of the electronic cigarette, including parameters such as a resistance value of the heating element, a power, and an outburst time of aerosol; for a corresponding heating element resistance value, the power at which the outburst time of aerosol is shortest is determined as the preset optimum power.

Preferably, in the embodiment of the present disclosure, the preset optimum power is 60W.

When the user set power is not less than 75W and the power overshoot scope is not less than 1W, it is needed to set the intermediate power to be 60W, so that an outburst of aerosol can be produced when the output power of the power device reaches the intermediate power.

S140: controlling the power device to output a power to the heating element, and enabling the output power of the power device to directly reach the intermediate power at a first stage.

The first stage mentioned above refers to a process in which the output power of the power device rises from 0W to the intermediate power, and the duration of the first stage is less than 50 us.

The directly reach mentioned above refers that the output power of the power device quickly reaches the intermediate power within 50 us without power attenuation and proportional adjustment.

Since the intermediate power is less than the target power and the intermediate power is 80%-90% of the target power or 70%-80% of the target power, in the condition that power attenuation and proportional adjustment are not performed at the first stage, the output power of the power device 20 will not reach the target power even if a power overshoot occurs; therefore, the output power from the power device 20 to the heating element 30 can be controlled to directly reach the intermediate power without exceeding the target power at the first stage, which greatly shortens the power rise time.

S150: adjusting the output power of the power device to gradually reach the target power at a second stage, a duration of the first stage being less than a duration of the second stage; and The second stage mentioned above refers to a process in which the output power of the power device rises from the intermediate power to the target power.

The gradually reach mentioned above refers that, during the process in which the output power of the power device rises from the intermediate power to the target power, the output power of the power device needs to be adjusted to gradually rise to slowly reach the target power.

Since the output power is adjusted at the second stage, the duration of the first stage is less than the duration of the second stage.

Figure 8:
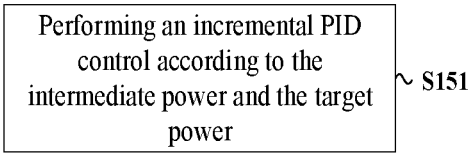
FIG. 8 is a specific flowchart of S150.

Referring to FIG. 8, the step of adjusting the output power of the power device to gradually reach the target power at a second stage specifically includes:

S151: performing an incremental PID control according to the intermediate power and the target power.

The incremental PID control mentioned above is a control algorithm which performs a PID control through an increment of a controlled variable (a difference between the current controlled variable and the last controlled variable).

S151 specifically includes: calculating a power output proportion according to a difference value between the intermediate power and the target power, and then controlling, according to the power output proportion, the output power of the power device to gradually reach the target power from the intermediate power.

S160: controlling the power device to constantly output the target power to the heating element at a third stage.

The third stage mentioned above refers to a process in which the power device constantly outputs the target power.

The power device constantly outputs the target power to the heating element, that is, the heating element heats an atomization substrate to generate an aerosol according to the target power.

The power control method of the electronic cigarette provided in the embodiment of the disclosure controls, through setting an intermediate power less than a target power according to the target power, the output power of the power device to directly reach the intermediate power at a first stage, then adjusts the output power of the power device to gradually reach the target power from the intermediate power at a second stage, and finally constantly outputs the target power at a third stage (as shown in FIG. 1*b*), thereby shortening the process of power attenuation and proportional adjustment at the first stage, so that the power rise time is shortened; therefore, the aerosolization time of the electronic cigarette is shortened, the ignition speed of the electronic cigarette is improved, and the user experience is better.

Embodiment 3

Figure 9:
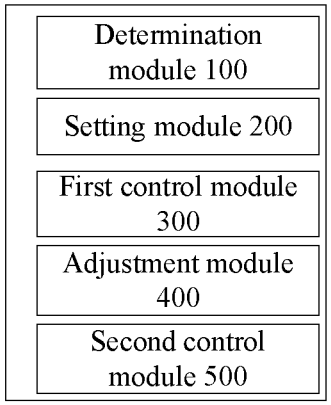
FIG. 9 is a structure diagram of a power control device of an electronic cigarette provided in an embodiment of the present disclosure.

Referring to FIG. 9, which shows a structure diagram of a power control device of an electronic cigarette provided in an embodiment of the present disclosure; the power control device is applied to an electronic cigarette; the electronic cigarette is the one described in the above embodiments. Functions of each module of the device provided in the embodiment of the present disclosure are executed by the above controller 10, to control an output power of a power device to a heating element. The power control device of the electronic cigarette includes:

- a determination module 100, which is used for determining a target power;
- a setting module 200, which is used for setting an intermediate power according to the target power, the intermediate power being less than the target power;
- a first control module 300, which is used for controlling the power device to output a power to the heating element, and enabling the output power of the power device to directly reach the intermediate power at a first stage;
- an adjustment module 400, which is used for adjusting the output power of the power device to gradually reach the target power at a second stage, a duration of the first stage being less than a duration of the second stage; and
- a second control module 500, which is used for controlling the power device to constantly output the target power to the heating element at a third stage.

Figure 10:
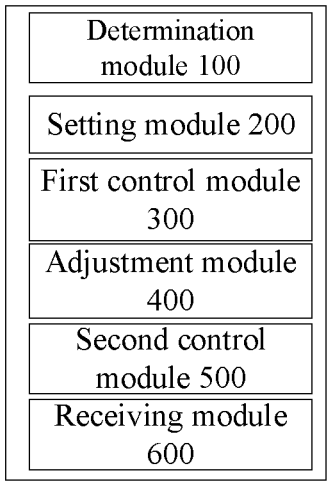
FIG. 10 is a structure diagram of a power control device of an electronic cigarette provided in another embodiment of the present disclosure.

Referring to FIG. 10, the power control device of the electronic cigarette further includes:

- a receiving module 600, which is used for receiving a start instruction before the determination module 600 determines the target power, the start instruction including a user set power.

At this time, the determination module 100 determines the user set power as the target power.

Figure 11:
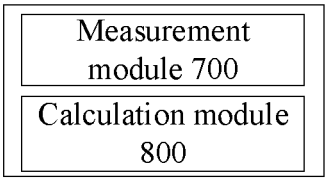
FIG. 11 is a structure diagram of a power control device of an electronic cigarette provided in yet another embodiment of the present disclosure.

Referring to FIG. 11, the power control device of the electronic cigarette further includes:

- a measurement module 700, which is used for measuring a current voltage of the power device and a resistance value of the heating element; and
- a calculation module 800, which is used for calculating a maximum allowed power of the electronic cigarette according to the current voltage of the power device and the resistance value of the heating element.

At this time, the target power may be the user set power contained in the start instruction received by the controller, also may the maximum allow power of the electronic cigarette calculated by the controller according to the current voltage of the power device and the resistance value of the heating element.

Based on this, the determination module 100 further includes:

a comparison module, which is used for comparing the maximum allowed power with the user set power;

if the maximum allowed power is less than the user set power, determining the maximum allowed power as the target power;

otherwise, determining the user set power as the target power.

Based on this, the setting module 200 further includes:

a judgement module, which is used for: when the target power is the maximum allowed power, judging whether the maximum allowed power is less than a first threshold, and if the maximum allowed power is less than the first threshold, setting the intermediate power to be 80%-90% of the maximum allowed power;

otherwise, judging whether the maximum allowed power is less than a second threshold, if the maximum allowed power is less than the second threshold, setting the intermediate power to be 70%-80% of the maximum allowed power;

otherwise, setting a preset optimum power as the intermediate power.

When the target power is the user set power, the judgement module is further used for: judging whether the user set power is less than a first threshold, if the user set power is less than the first threshold, setting the intermediate power to be 80%-90% of the user set power;

otherwise, judging whether the user set power is less than a second threshold, if the user set power is less than the second threshold, setting the intermediate power to be 70%-80% of the user set power;

otherwise, setting a preset optimum power as the intermediate power.

It is understandable that the receiver module 600 receives a start instruction before the determination module 100 determines a target power, the start instruction contains a user set power, and then the determination module 100 determines the user set power as the target power; if the measurement module 700 measures a current voltage of the power device and a resistance value of the heating element, and the calculation module 800 calculates a maximum allowed power of the electronic cigarette according to the current voltage of the power device and the resistance value of the heating element that are measured by the measurement module 700, then the comparison module in the determination module 100 compares the maximum allowed power with the use set power; if the maximum allowed power is less than the user set power, the maximum allowed power is determined as the target power; otherwise, the user set power is determined as the target power; then, the setting module 200 sets an intermediate power according to the target power determined by the determination module 100, the intermediate power is less than the target power; specifically, when the target power is the maximum allowed power, the judgement module in the setting module 200 judges whether the maximum allowed power is less than a first threshold; if the maximum allowed power is less than the first threshold, the intermediate power is set to be 80%-90% of the maximum allowed power; otherwise, the judgement module judges whether the maximum allowed power is less than a second threshold, if the maximum allowed power is less than the second threshold, the intermediate power is set to be 70%-80% of the maximum allowed power; otherwise, a preset optimum power is set as the intermediate power; when the target power is the user set power, the judgement module in the setting module 200 judges whether the user set power is less than a first threshold; if the user set power is less than the first threshold, the intermediate power is set to be 80%-90% of the user set power; otherwise, the judgement module judges whether the user set power is less than a second threshold, if the user set power is less than the second threshold, the intermediate power is set to be 70%-80% of the user set power; otherwise, a preset optimum power is set as the intermediate power; at this time, the first control module 300 controls the power device to output a power to the heating element, and enables the output power of the power device to directly reach the intermediate power at a first stage; the adjustment module 400 adjusts the output power of the power device to gradually reach the target power at a second stage, and a duration of the first stage is less than a duration of the second stage; the second control module 500 controls the power device to constantly output the target power to the heating element at a third stage.

Since the device embodiment and the method embodiment are based on one same idea, the content of the device embodiment can refer to that of the method embodiment if no conflict is incurred. No further description is needed here.

The power control device of the electric cigarette provided in the embodiment of the present disclosure can shorten the power rise time, so that the aerosolization time of the electronic cigarette is shortened, the ignition speed of the electronic cigarette is improved, and the user experience is better.

Embodiment 4

Figure 12:
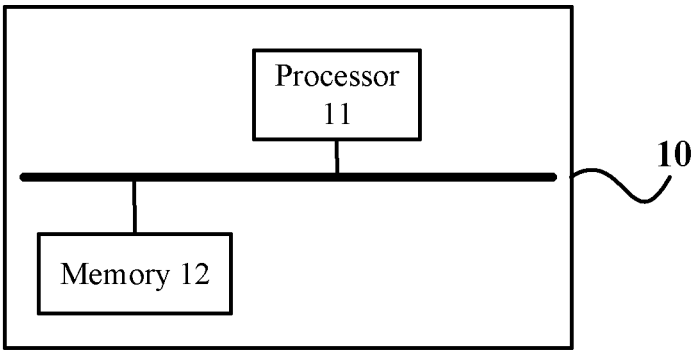
FIG. 12 is a hardware structure diagram of an electronic cigarette provided in an embodiment of the present disclosure.

Referring to FIG. 12, which shows a structure diagram of a hardware structure of an electronic cigarette provided in an embodiment of the present disclosure. The electronic cigarette is the one described in the above embodiments. The hardware module provided in the embodiment of the present disclosure is mainly integrated in a controller 10, so that the controller 10 can execute the power control method of the electronic cigarette described in the above embodiment, and also can implement the functions of each module of the power control device of the electronic cigarette described in the above embodiment.

As shown in FIG. 12, the controller 10 includes:

one or more processors 11 and a memory 12, wherein FIG. 12 takes one processor 11 for example.

The processor 11 and the memory 12 may be connected through a bus or other modes, and FIG. 12 takes a bus connection for example.

The memory 12, as a non-volatile computer readable storage medium, may be used for storing non-volatile software programs, non-volatile computer executable programs and modules, for example, a program instruction corresponding to the power control method of the electronic cigarette provided in the above embodiment of the present disclosure and a module corresponding to the power control device of the electronic cigarette (for example, the determination module 100, the setting module 200, the first control module 300, the adjustment module 400, the second control module 500, etc.). The processor 11 executes various function application and data processing of the power control method of the electronic cigarette, that is, implementing the power control method of the electronic cigarette in the above method embodiment and the functions of each module of the above device embodiment, through running the non-volatile software programs, instructions and modules stored in the memory 12.

The memory 12 may include a program storage area and a data storage area, wherein the program storage area can store the application needed by an operating system or at least one function, and the data storage area can store data and the like created according to the power control device of the electronic cigarette.

The data storage area further stores preset data, including a preset optimum power, a first threshold, a second threshold, a preset power table, etc.

In addition, the memory 12 may include a high speed random access memory, and may further include a non-volatile memory, for example, at least one disk storage device, a flash memory device or other solid-state non-volatile storage devices. In some embodiments, the memory 12 optionally includes a remote memory relative to the processor 11. The remote memory can be connected to the processor 11 through a network. Instances of the above network include but not limited to Internet, intranet, local area network, mobile communication network and combinations thereof.

The program instruction and the one or more modules are stored in the memory 12 and, when executed by the one or more processors 11, will execute each step of the power control method of the electronic cigarette in any one of the above method embodiments, or implement the functions of each module of the power control device of the electronic cigarette in any one of the above device embodiments.

The above product can execute the method provided by the embodiment of the present disclosure and has corresponding function modules and beneficial effects to execute the method. Technical details that are not described in detail in the present embodiment can refer to the method provided by the embodiment of the disclosure.

The embodiment of the present disclosure provides a nonvolatile computer readable storage medium, the computer readable storage medium stores a computer executable instruction, and the computer executable instruction is executed by one or more processors (for example, one processor 11 in FIG. 12) to cause the computer to execute each step of the power control method of the electronic cigarette in any one of the above method embodiments, or implement the functions of each module of the power control device of the electronic cigarette in any one of the above device embodiments.

The embodiment of the present disclosure further provides a computer program product, the computer program product includes a computer program stored in a nonvolatile computer readable storage medium, and the computer program includes a program instruction, which, when executed by one or more processors (for example, one processor 11 in FIG. 12), causes the computer to execute each step of the power control method of the electronic cigarette in any one of the above method embodiments, or implement the functions of each module of the power control device of the electronic cigarette in any one of the above device embodiments.

The device embodiments described above are merely for illustration. The unit module described as a separate component may be or may not be physically separated; the component, displayed as a unit, may be or may not be a physical unit, that is, it may be located at one place, or may be distributed on a plurality of network module units. Part or all modules may be selected to realize the purpose of the embodiment scheme according to actual needs.

Through the description of the above implementations, the ordinary skill in the art can clearly understand that each implementation can be achieved by means of software plus a common hardware platform, of course as well as through hardware. The ordinary skill in the art can understand that all or part of the processes in the above method embodiments may be implemented by instructing related hardware through a computer program which may be stored in a computer readable storage medium and which, when executed, may include, for example, the process of the embodiment of the above methods. The storage medium may be a disk, a compact disk, a Read-Only Memory (ROM) or Random Access Memory (RAM) and the like.

The above are embodiments of the present disclosure merely and are not intended to limit the patent scope of the present disclosure. Any equivalent structures or equivalent process transformation made according to the description and the accompanying drawings of the present disclosure, or any equivalent structures or equivalent flow modifications applied in other relevant technical fields directly or indirectly are intended to be included in the patent protection scope of the present disclosure.

What is claimed is:

1. A power control method of an electronic cigarette, the power control method being configured for controlling an output power of a power device to a heating element, characterized in that, wherein the power control method of the electronic cigarette comprises the following steps:

determining a target power;

setting an intermediate power according to the target power, the intermediate power being less than the target power;

controlling the power device to output a power to the heating element, and enabling the output power of the power device to directly reach the intermediate power at a first stage;

adjusting the output power of the power device to gradually reach the target power at a second stage, a duration of the first stage being less than a duration of the second stage; and controlling the power device to constantly output the target power to the heating element at a third stage.

2. The method according to claim 1, wherein the duration of the first stage is less than 50 microseconds.

3. The method according to claim 1, wherein before determining the target power, the method further comprises:

receiving a start instruction, the start instruction comprising a user set power.

4. The method according to claim 3, wherein the method further comprises:

measuring a current voltage of the power device and a resistance value of the heating element; and calculating a maximum allowed power of the electronic cigarette according to the current voltage of the power device and the resistance value of the heating element.

5. The method according to claim 4, wherein the step of determining a target power comprises:

comparing the maximum allowed power with the user set power;

if the maximum allowed power is less than the user set power, determining the maximum allowed power as the target power;

otherwise, determining the user set power as the target power.

6. The method according to claim 5, wherein when the target power is the maximum allowed power, the step of setting an intermediate power according to the target power comprises:

judging whether the maximum allowed power is less than a first threshold, if the maximum allowed power is less than the first threshold, setting the intermediate power to be 80%-90% of the maximum allowed power;

otherwise, judging whether the maximum allowed power is less than a second threshold, if the maximum allowed power is less than the second threshold, setting the intermediate power to be 70%-80% of the maximum allowed power;

otherwise, setting a preset optimum power as the intermediate power.

7. The method according to claim 5, wherein when the target power is the user set power, the step of setting an intermediate power according to the target power comprises:

judging whether the user set power is less than a first threshold, if the user set power is less than the first threshold, setting the intermediate power to be 80%-90% of the user set power;

otherwise, judging whether the user set power is less than a second threshold, if the user set power is less than the second threshold, setting the intermediate power to be 70%-80% of the user set power;

otherwise, setting a preset optimum power as the intermediate power.

8. The method according to claim 1, wherein the step of adjusting the output power of the power device to gradually reach the target power at a second stage comprises:

performing an incremental PID control according to the intermediate power and the target power.

9. A power control device of an electronic cigarette, the power control device being configured for controlling an output power of a power device to a heating element, wherein the power control device of the electronic cigarette comprises:

a determination module configured for determining a target power;

a setting module, configured for setting an intermediate power according to the target power, the intermediate power being less than the target power;

a first control module, configured for controlling the power device to output a power to the heating element, and enabling the output power of the power device to directly reach the intermediate power at a first stage;

an adjustment module, configured for adjusting the output power of the power device to gradually reach the target power at a second stage, a duration of the first stage being less than a duration of the second stage; and a second control module, configured for controlling the power device to constantly output the target power to the heating element at a third stage.

10. The device according to claim 9, wherein the device further comprises:

a receiving module, configured for receiving a start instruction before determining the target power, the start instruction comprising a user set power.

11. The device according to claim 10, wherein the device further comprises:

a measurement module, configured for measuring a current voltage of the power device and a resistance value of the heating element; and a calculation module, configured for calculating a maximum allowed power of the electronic cigarette according to the current voltage of the power device and the resistance value of the heating element.

12. The device according to claim 11, the determination module further comprises:

a comparison module, configured for comparing the maximum allowed power with the user set power;

if the maximum allowed power is less than the user set power, determining the maximum allowed power as the target power;

otherwise, determining the user set power as the target power.

13. The device according to claim 12, wherein when the target power is the maximum allowed power, the setting module further comprises:

a judgement module, configured for judging whether the maximum allowed power is less than a first threshold, and if the maximum allowed power is less than the first threshold, setting the intermediate power to be 80%-90% of the maximum allowed power;

otherwise, judging whether the maximum allowed power is less than a second threshold, if the maximum allowed power is less than the second threshold, setting the intermediate power to be 70%-80% of the maximum allowed power;

otherwise, setting a preset optimum power as the intermediate power.

14. The device according to claim 13, wherein when the target power is the user set power, the judgement module is further configured for:

judging whether the user set power is less than a first threshold, if the user set power is less than the first threshold, setting the intermediate power to be 80%-90% of the user set power;

otherwise, judging whether the user set power is less than a second threshold, if the user set power is less than the second threshold, setting the intermediate power to be 70%-80% of the user set power;

otherwise, setting a preset optimum power as the intermediate power.

15. An electronic cigarette, characterized in that, the electronic cigarette comprising:

at least one processor; and a memory in communication connection with the at least one processor; wherein the memory configured for storing an instruction that can be executed by the at least one processor, and the instruction is executed by the at least one processor so that the at least one processor can execute the method according to claim 1.

* * * * *